United States Patent [19]

Levick

[11] Patent Number: 4,509,674

[45] Date of Patent: Apr. 9, 1985

[54] PITA BREAD SANDWICH HOLDER

[76] Inventor: Lois B. Levick, 32 Savoy Rd., Framingham, Mass. 01701

[21] Appl. No.: 486,259

[22] Filed: Apr. 18, 1983

[51] Int. Cl.[3] ..... B65D 5/32

[52] U.S. Cl. ..... 229/23 R; 206/515; 220/23.8; 220/70; 229/DIG. 13; 248/174

[58] Field of Search ..... 229/23 R, DIG. 7, DIG. 13; 383/104, 907; 220/23.8, 70; 206/515, 518, 519, 496, 120; 248/174, 176, 469

[56] References Cited

U.S. PATENT DOCUMENTS

| | | | |
|---|---|---|---|
| 1,252,073 | 1/1918 | Achert | 248/174 X |
| 1,804,343 | 5/1931 | Hytken | 383/907 X |
| 1,921,256 | 8/1933 | Hiester | 220/23.8 |
| 2,071,394 | 2/1937 | Douglas | 248/174 X |
| 2,352,684 | 7/1944 | Braddock | 206/515 X |
| 2,493,633 | 1/1950 | Mart | 206/519 |
| 2,677,350 | 5/1954 | Prestidge et al. | 220/23.8 X |
| 2,867,940 | 1/1959 | Pitton | 220/70 X |
| 3,021,001 | 2/1962 | Donofrio | 220/23.8 X |
| 3,622,036 | 11/1971 | Bongaerts | 220/70 |
| 4,004,501 | 1/1977 | Guerrero | 220/23.8 X |

FOREIGN PATENT DOCUMENTS

| | | | |
|---|---|---|---|
| 144173 | 2/1954 | Sweden | 206/515 |

*Primary Examiner*—William Price
*Assistant Examiner*—Gary E. Elkins
*Attorney, Agent, or Firm*—Irving M. Kriegsman

[57] ABSTRACT

A holder for use in supporting a pita bread sandwich in an upright position on a table top is constructed from two identical cardboard blanks, each of which is cut and scored to define a trapezoidally shaped lower panel, a pair of trapezoidally shaped side section panels hingedly connected to the sides of the lower panel, a pair of glue flaps hingedly connected on either side of the side section panels, a semicircular shaped upper panel hingedly connected to the top of the lower panel and a plurality of glue tabs hingedly connected to the upper panel along its outer edge. In assembling the holder the side section panels and upper panel on each blank are folded forwardly in front of the lower panel and the glue flaps and glue tabs folded back. The glue flaps and glue tabs on one blank are then secured to the glue flaps and glue tabs respectively on the other blank. Once assembled the two upper panels define a semi-circular shaped pocket open at the top for receiving and holding the pita bread sandwich, the two lower panels serve as supports for standing the holder upright on the table top and the side sections define tapered pleats connecting the two lower panels at their side edges. In another disclosed embodiment the holder is a unitary molded plastic structure. Two versions are described, one for holding a single pita bread and the other for holding a plurality of pita bread sandwiches.

10 Claims, 8 Drawing Figures

PITA BREAD SANDWICH HOLDER

BACKGROUND OF THE INVENTION

The present invention relates generally to holders and more particularly to a holder for use in supporting a pita bread sandwich in an upright position on a table top or other similar surface.

Pita bread sandwiches have become a very popular type of bread sandwich over the past few years. One reason for their popularity has been the nutritional value of the particular ingredients used in the pita bread. Another reason for their popularity has been the disk-shaped hollow configuration of the pita bread itself which when cut off at the top or near the middle can be opened to form a curved pocket which may be filled or stuffed with salads, vegetables, cold cuts and the like. One of the problems with pita bread sandwiches, however, is that they are not self standing about their curved outer edge but rather must either be held continuously in the hands of a person, or balanced, if possible against another object in a sort of upright position or placed down on a side. When the sandwich is placed down on a side, the food products stuffed inside the pocket will very often fall out onto the supporting surface on which it is resting.

As can be appreciated, the need exists for a holder which is self-standing and which is capable of supporting a pita bread sandwich in an upright position. Such a holder would eliminate the necessity of having to hold the bread continuously either while it is being stuffed or after it has been stuffed and is being consumed.

Accordingly, it is an object of this invention to provide a new and improved holder.

It is another object of this invention to provide a holder for supporting a pita bread sandwich in an upright position.

It is a further object of this invention to provide a holder for supporting a pita bread sandwich in an upright position which is self supporting.

It is still a further object of this invention to provide a holder for supporting a pita bread sandwich in an upright position which is self supporting and which can be made of foldable sheet material.

It is still a further object of this invention to provide a holder for supporting a pita bread sandwich in an upright position which is self supporting, which is easy and inexpensive to manufacture, which can be mass produced and which is easy to use.

It is another object of this invention to provide a holder for supporting a pita bread in an upright position which is a unitary plastic mold.

It is still another object of this invention to provide a holder for supporting a plurality of pita breads at one time, each in an upright position.

SUMMARY OF THE INVENTION

A holder for use in supporting a pita bread sandwich in an upright position on a table top or other similar surface constructed according to the teachings of the present invention comprises two identical blanks, each blank comprising a sheet of foldable material cut and scored to define a lower panel having a top edge, a bottom end and a pair of side edges, a pair of side section panels hingedly connected to the side edges of the lower panel, one on each side thereof, a pair of glue flaps hingedly connected to the outer side edges of the side section panels, one on each side thereof, an upper panel hingedly connected to the top edge of the lower panel, and a plurality of glue tabs hingedly connected to the upper panel about its outer edge.

In two other embodiments the holder is a unitary molded structure made of plastic.

The foregoing and other objects and advantages will appear from the description to follow. In the description, reference is made to the accompanying drawing which forms a part thereof, and in which is shown by way of illustration, specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawing in which like reference numerals or characters represent like parts.

DETAILED DESCRIPTION OF PREFERRED EMBODIMENTS

The present invention is directed to a holder for use in supporting a pita bread sandwich in an upright position on a table top or other similar surface. Two embodiments of the invention will hereinafter be described. In one embodiment, the holder is made from a pair of blanks of foldable material and is intended to be used primarily as a disposable type of holder. In the other embodiment, the holder is a unitary structure of rigid material and is intended to be reusable.

Although the invention will be described in connection with holding a pita bread sandwich it is to be understood that the holder is also applicable for use, if desired, in holding taco shells or other pouch type sandwiches or other types of food products and items.

Figure 1:
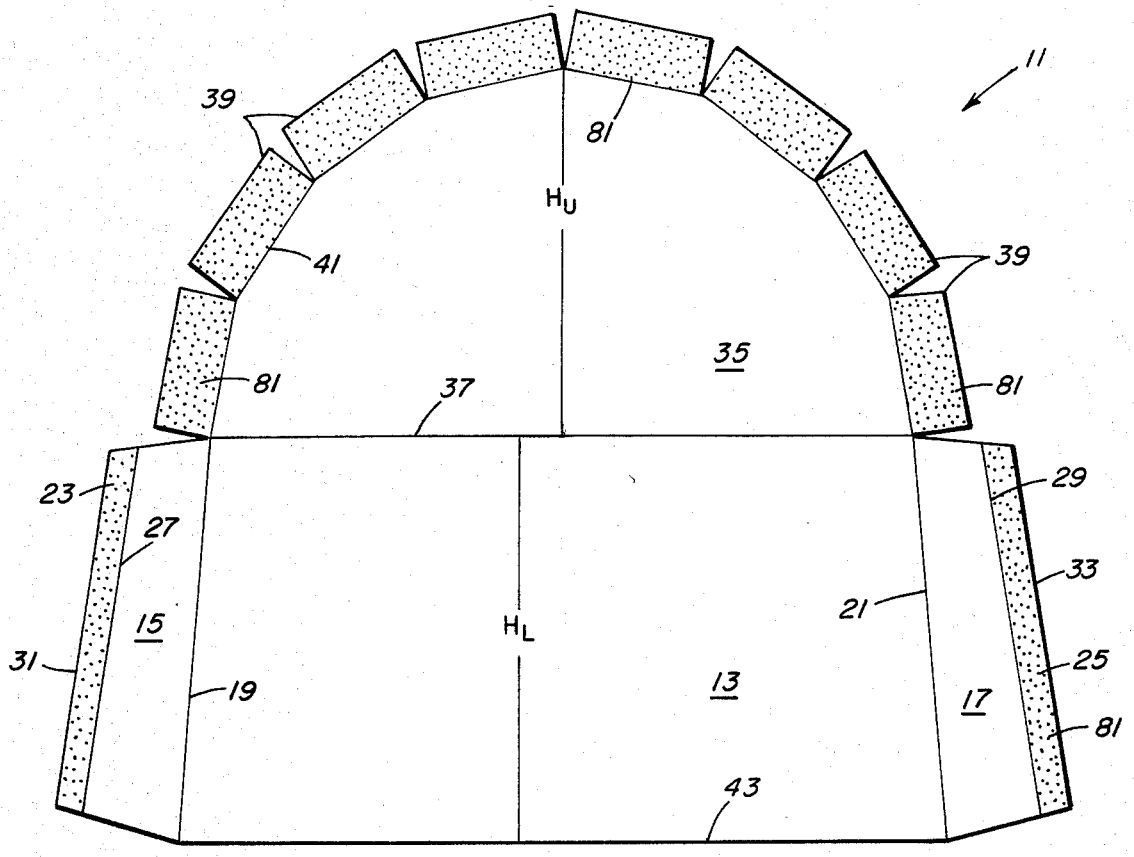
FIG. 1 is a plan view of one of the two blanks utilized to make the holder of the present invention.

Referring now to the drawings, and in particular to FIG. 1 there is illustrated one of the two blanks from which the holder is made according to one embodiment of the invention, the blank being identified by reference numeral 11.

Blank 11 is a unitary blank made of cardboard, paperboard or other foldable sheet material, including plastics, which is of suitable thickness and which is cut and scored as will hereinafter be described.

As can be seen, blank 11 is organized about a lower panel 13 which is trapezoidally shaped. When the holder is constructed lower panel 13 constitutes one of the support walls for supporting the holder on the table top. A pair of side section panels 15 and 17 of trapezoidal configuration are hingedly connected to lower panel 13 about fold lines 19 and 21 which define the left and right side edges, repectively, of lower panel 13. When the holder is constructed, each one of the side section panels defines one-half of a tapered pleat. A pair of glue flaps 23 and 25 of trapezoidal configuration are hingedly connected to side section panels 15 and 17 about fold lines 27 and 29 which define the outer side edges of side section panels 15 and 17. As can be seen, fold lines 19, 21, 27 and 29 and the outer edges 31 and 33 of glue flaps 23 and 25 each extend upwardly and inwardly.

An upper panel 35 of semicircular configuration is hingedly connected to lower panel 13 about a fold line 37 which defines the upper edge of lower panel 13 and the bottom straight edge of upper panel 35. When the holder is constructed, upper panel 35 defines one-half of a semicircular shaped pocket having an arcuate shaped inner edge and open at the top for receiving a pita bread sandwich. Finally, a plurality of glue tabs 39, are hingedly connected to upper panel 35 about its arcuate outer edge 41.

Bottom edge 43 of panel 13 is parallel to fold line 37 and is adapted to engage the table top surface when the holder is assembled and in use.

The height Hu of upper panel 35 is less than the height Hl of lower panel 13 so that only bottom edge 43 of lower panel 13 will contact the table top surface when the holder is assembled.

Figure 2:
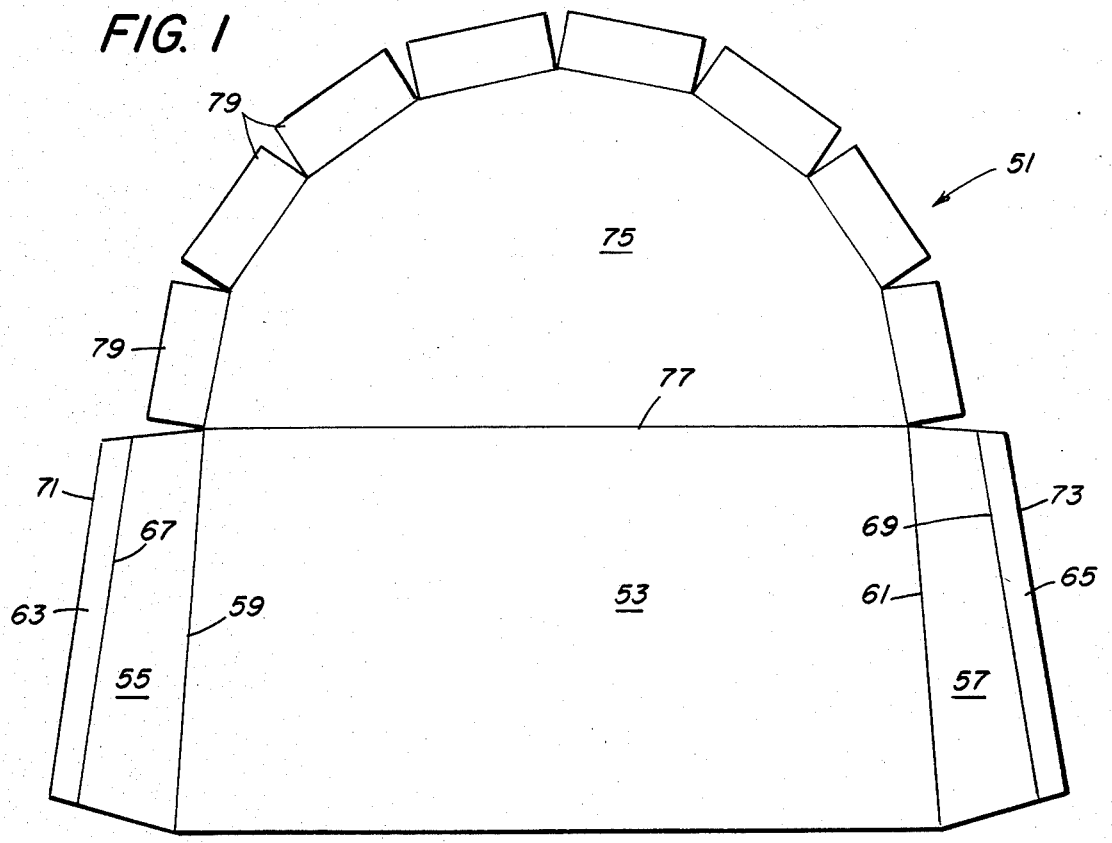
FIG. 2 is a plan view of the other blank utilized to make the holder of the present invention.

Referring now to FIG. 2, there is illustrated the other blank which is used to make the holder, the blank being identified by reference numeral 51. Blank 51 is identical in construction to blank 11. Thus, blank 51 includes a lower panel 43, a pair of side section panels 55 and 57 having inner side edges 59 and 61, a pair of glue flaps 63 and 65, having inner side edges 67 and 69 and outer side edges 71 and 73, an upper panel 75 having a lower edge 77 and a plurality of glue tabs 79 which correspond to the equivalent parts in blank 11.

In forming a holder of this invention from the two blanks 11 and 51, a quantity of a suitable adhesive 81, such as glue, is first applied to glue panels 23 and 25 and glue tabs 39 of blank 11. Alternatively the adhesive may be applied to glue panels 63 and 65 and glue tabs 79 of blanks 51 or may be applied to the glue panels and glue tabs of both blanks. After this, the two blanks are folded and joined together as will hereinafter be described.

Figure 3:
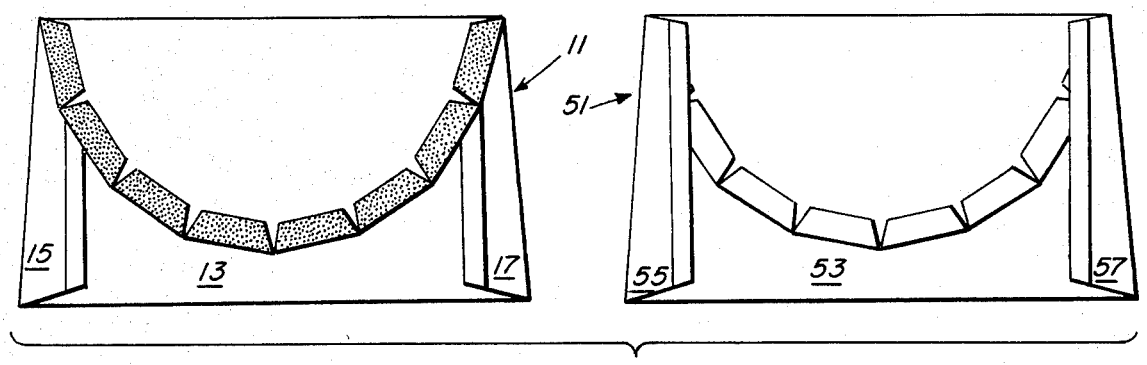
FIGS. 3 and 4 are views illustrating how the blanks shown in FIGS. 1 and 2 are assembled to form the holder.

As can be seen in FIG. 3, the first step in forming the holder is to fold side panels 15 and 17 of blank 11 about their fold lines 19 and 21 over in front of lower panel 13. At the same time, glue flaps 23 and 25 are folded in a backwardly direction about their fold lines 27 and 29. Then, upper panel 35 is folded over about fold line 37 in front of lower panel 13 and in front of panels 15 and 17 and flaps 23 and 25. Turning now to blank 51, upper panel 75 is folded over about fold line 77 in front of lower panel 53 and glue tabs 79 folded in a backward direction. Then, side panel sections 55 and 57 are folded over about their fold lines 59 and 61 in front of lower panel 53, upper panel 75 and glue tabs 79. Then, glue panels 63 and 65 are folded in a backward direction about their fold lines 67 and 69. As can be seen, in blank 11 the side sections and glue panels are located between the upper and lower panels, whereas, in blank 51 the upper panel is located between the lower panel and the side section panels.

Figure 4:
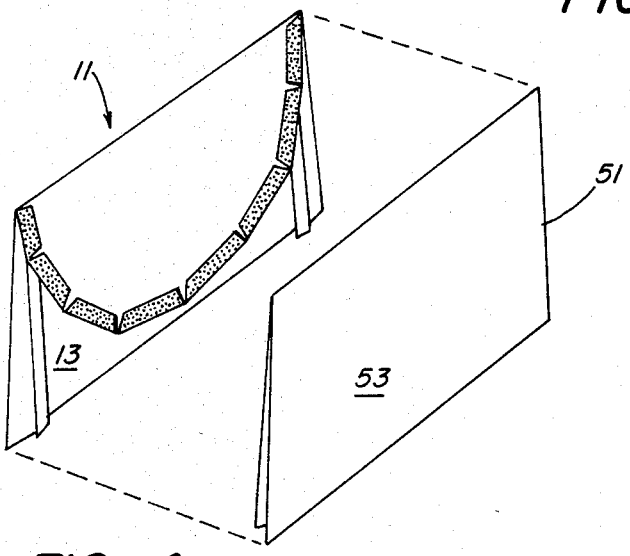

Blanks 11 and 51 are than brought together as shown in FIG. 4 and formed into a holder which is self supporting by securing glue flaps 23 and 25 to glue flaps 63 and 65, respectively, and glue tabs 39 to glue tabs 79.

As can be appreciated, upper panels 35 and 75 form a semicircular pocket for receiving and holding the pita bread sandwich in an upright position, the pocket having an open top and a curved bottom edge defined by the outer edges of the two upper panels. The two lower panels define supports for supporting the pocket and the side panel sections define tapered pleats connecting the side edges of one lower panel with the side edges of the other lower panel.

In using the holder, the two lower panels are preferably spread apart from one another from the top so that the pita bread sandwich may be easily inserted and also spread apart from one another from the bottom to form support walls that extend upwardly and inwardly.

Figure 5:
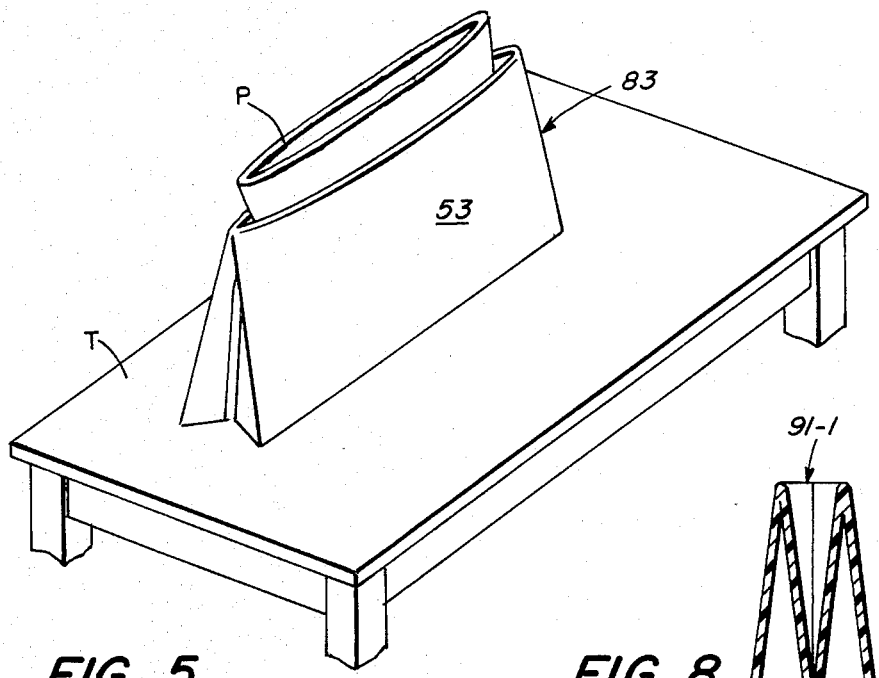
FIG. 5 is an isometric view of the holder fully assembled, resting on a table top and supporting a pita bread sandwich.

The fully assembled holder, identified by reference numeral 83, sealed on a table top T and supporting a pita bread sandwich P is shown in FIG. 5.

Figure 6:
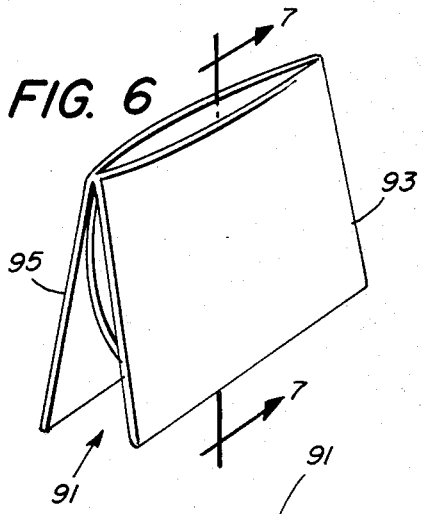
FIG. 6 is an isometric view of another embodiment of the invention.
Figure 7:
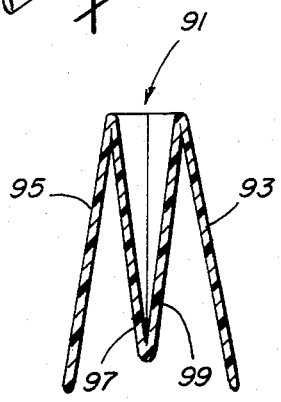
FIG. 7 is a section view of the embodiment of the invention shown in FIG. 6 taken along lines 6—6.

Referring now to FIGS. 6 and 7 there is illustrated another embodiment of a holder constructed according to this invention and identified by reference numeral 91.

Holder 91 is an unitary structure made of a rigid plastic or other suitable material such as wood or metal. Holder 91 includes a front wall 93 a back wall 95 and a pair of semicircular shaped inwardly slanted inner walls, 97 and 99 joined at their bottom edges to define a semicircular shaped pocket open at the top.

Holder 83 is intended to be used primarily as a disposable type holder while holder 91 is intended for use primarily as a reuseable type holder.

Figure 8:
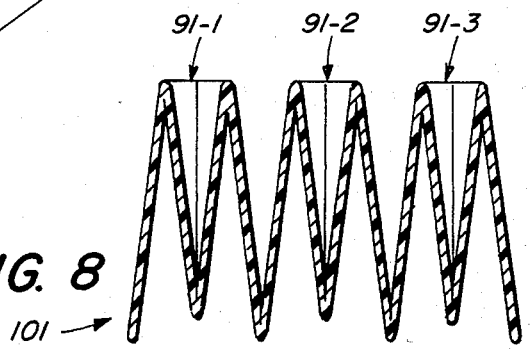
FIG. 8 is an isometric view of still another embodiment of the invention.

In FIG. 8 there is shown still another embodiment of a holder according to this invention, the holder being identified by reference numeral 101. Holder 101 is a unitary structure and is made up of a plurality of holders 91 joined together in a side-by-side relationship and identified by reference numerals 91-1, 91-2 and 91-3, the number of holders shown being for illustrative purposes only. Holder 101 is especially useful in restaurants and the like where it may be desirable to support a plurality of pita breads each in an upright position so that they may be stuffed individually and quickly. Alternatively, the holders may be arranged end-to-end rather than side-by-side.

The embodiments of the present invention are intended to be merely exemplary and those skilled in the art shall be able to make numerous variations and modifications without departing from the spirit of the present invention. All such variations and modifications are intended to be within the scope of the present invention as defined in the appended claims.

What is claimed is:

1. A blank for use in the construction of a holder for supporting a pita bread sandwich in an upright position on a table top comprising a sheet of foldable material cut and scored to define:

a. a lower panel having an upper edge, a bottom edge and a pair of side edges, b. a pair of side sections panels hingedly connected to the side edges of the lower panel, one on each side thereof, c. a pair of glue flaps hingedly connected to the outer side edges of the side section panels, one on each side thereof, d. an upper panel hingedly connected to the top edge of the lower panel, and e. a plurality of glue tabs hingedly connected to the upper panel, f. said upper panel being of semicircular configuration and having a straight bottom edge and an arcuate top edge.

2. The blank of claim 1 and wherein said lower panel is trapezoidally shaped.

3. The blank of claim 2 and wherein said side panel sections are trapedzoidally shaped said glue panels are trapezoidally shaped and said glue tabs each have a bottom edge, a top edge and a pair of side edges.

4. The blank of claim 3 and wherein said sheet of foldable material is cardboard.

5. A blank construction for use in forming a holder for supporting a pouch type bread sandwich in an upright position on a table top, said blank construction comprising two identical blanks, each blank comprising a sheet of foldable material cut and scored to define:

a. a lower panel having an upper edge, a bottom edge and a pair of side edges, b. a pair of side section panels hingedly connected to the side edges of the lower panel, one on each side thereof, c. a pair of glue flaps hingedly connected to the outer side edges of the side section panels, one on each side thereof, d. an upper panel of semicircular configuration hingedly connected to the top edge of the lower panel said upper panel having a bottom straight edge and an arcuate outer edge, and e. a plurality of glue tabs hingedly connected to the upper panel about its arcuate outer edge.

6. The blank construction of claim 5 and wherein said lower panel is trapezoidally shaped.

7. The blank construction of claim 6 and wherein said side panel sections are trapezoidally shaped, said glue flaps are trapezoidally shaped, and said glue tabs each include a bottom edge, a top edge and a pair of side edges.

8. The blank construction of claim 7 and wherein said blanks are made of cardboard.

9. A holder for use in supporting a pita bread sandwich in an upright position on a table top comprising:

a. a first blank of cardboard, said first blank comprising:

i. a trapezoidally shaped lower panel having a top edge, a bottom edge and a pair of side edges, ii. a pair of side section panels hingedly connected to the side edges of said lower panel, one on each side thereof and folded in front of said lower panel, iii. a pair of glue flaps hingedly connected to the side section panels, one on each side thereof, and folded in front of said side section panels, iv. an upper panel of semicircular configuration hingedly connected to the top edge of said lower panel and folded in front of said lower panel, said upper panel including an arcuate outer edge, v. a plurality of glue tabs hingedly connected to said upper panel about its outer edge and folded in front of said wall panel, b. a second blank of cardboard material, said second blank comprising:

i. a trapezoidally shaped lower panel having a top edge, a bottom edge and a pair of side edges, ii. a pair of side section panels hingedly connected to the side edges of said lower panel, one on each side thereof, behind said lower panel, iii. a pair of glue flaps hingedly connected to the side section panels, one on each side thereof, and folded behind said side sections, iv. an upper panel of semicircular configuration hingedly connected to the top edge of said lower panel and folded behind said lower panel, said second wall panel including an arcuate outer edge, v. a plurality of glue tabs hingedly connected to said upper panel about its outer edge and folded behind said upper panel, and c. means for securing the glue flaps on the first blank to the glue flaps on the second blank and the glue tabs on the first blank to the glue tabs on the second blank, d. whereby said two upper panels together define a pocket in which said pita bread sandwich may be placed.

10. The holder of claim 9 and wherein said means for securing said glue flaps and said glue tabs comprises glue.

* * * * *